US007843447B2

(12) United States Patent
Okuno

(10) Patent No.: US 7,843,447 B2
(45) Date of Patent: Nov. 30, 2010

(54) LIQUID CRYSTAL DISPLAY WITH FEEDBACK CIRCUIT PART

(75) Inventor: Takeshi Okuno, Suwon-si (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 1011 days.

(21) Appl. No.: 11/324,245

(22) Filed: Jan. 4, 2006

(65) Prior Publication Data

US 2006/0170640 A1 Aug. 3, 2006

(30) Foreign Application Priority Data

Jan. 31, 2005 (KR) ..... 10-2005-0008781

(51) Int. Cl.
*G09G 5/00* (2006.01)

(52) U.S. Cl. ..... 345/212; 345/87; 345/94; 345/204; 345/211

(58) Field of Classification Search ..... 345/204–212, 345/84–98, 100
See application file for complete search history.

(56) References Cited

U.S. PATENT DOCUMENTS

| | | | | |
|---|---|---|---|---|
| 3,938,318 | A * | 2/1976 | Collins | 368/67 |
| 5,283,477 | A * | 2/1994 | Shibata | 327/306 |
| 5,537,129 | A * | 7/1996 | Okada et al. | 345/90 |
| 5,638,087 | A * | 6/1997 | Tanaka et al. | 345/87 |
| 5,831,605 | A * | 11/1998 | Yasui et al. | 345/211 |
| 6,222,516 | B1 * | 4/2001 | Oda et al. | 345/94 |
| 6,246,221 | B1 * | 6/2001 | Xi | 323/280 |
| 6,392,626 | B1 * | 5/2002 | Moon | 345/94 |
| 6,483,727 | B2 * | 11/2002 | Oki et al. | 363/39 |
| 6,614,416 | B1 * | 9/2003 | Yamamoto et al. | 345/94 |
| 7,068,092 | B2 * | 6/2006 | Yi et al. | 327/374 |
| 2002/0063703 | A1 | 5/2002 | Furuhashi et al. | |
| 2003/0058204 | A1 * | 3/2003 | Moon | 345/87 |
| 2004/0001039 | A1 * | 1/2004 | Shino et al. | 345/100 |
| 2004/0012553 | A1 * | 1/2004 | Lee et al. | 345/87 |
| 2005/0253836 | A1 * | 11/2005 | Kim et al. | 345/212 |

FOREIGN PATENT DOCUMENTS

| | | |
|---|---|---|
| JP | 06-202070 | 7/1994 |
| JP | 09-064747 | 3/1997 |
| JP | 2004-208367 | 7/2004 |
| JP | 2004208367 A * | 7/2004 |

OTHER PUBLICATIONS

*Office Action* from the Japanese Patent Office issued in Applicant's corresponding Japanese Patent Application No. 2005-198784 dated Jul. 15, 2008.

Korean Office Action of the Korean Patent Application No. 2005-8781, issued on Jun. 23, 2006.

* cited by examiner

*Primary Examiner*—Lun-Yi Lao
*Assistant Examiner*—Gregory J Tryder
(74) *Attorney, Agent, or Firm*—Robert E. Bushnell, Esq.

(57) ABSTRACT

In a liquid crystal display device having a feedback circuit part, the feedback circuit part prevents black points and blinking pixels from being generated on a liquid crystal display panel by compensating ripple voltages generated from a common electrode of a common substrate. The feedback circuit part comprises a negative feedback part, a buffer part, a low-pass filter part, and first and second impedances interconnecting the low-pass filter part and the negative feedback part.

21 Claims, 4 Drawing Sheets

LIQUID CRYSTAL DISPLAY WITH FEEDBACK CIRCUIT PART

CLAIM OF PRIORITY

This application makes reference to, incorporates the same herein, and claims all benefits accruing under 35 U.S.C. §119 from an application entitled LIQUID CRYSTAL DISPLAY WITH FEEDBACK CIRCUIT PART earlier filed in the Korean Intellectual Property Office on 31 Jan. 2005 and there duly assigned Serial No. 10-2005-0008781.

BACKGROUND OF THE INVENTION

1. Technical Field

The present invention relates to a liquid crystal display device and, more particularly, to a liquid crystal display device with a feedback circuit part to compensate for ripple voltages.

2. Related Art

Recently, reduced weight lightening and a thin shape of display devices have been required consistent with reduced weight and thin shape of personal computers, televisions, etc., and flat panel displays such as liquid crystal display devices (as opposed to cathode ray tube (CRT) device) are continuously being developed according to such a demand.

The liquid crystal display device is a display device for obtaining a desired image signal by impressing an electric field on liquid crystals having an anisotropic dielectric constant, and injected between two substrates, and controlling the intensity of the electric field, thereby controlling the amount of light transmitted onto the substrates from an external light source (a backlight).

The liquid crystal display device is typical of display devices in simply portable flat panel displays, and a thin film transistor-liquid crystal display device (TFT-LCD) in which a thin film transistor is used as a switching device is mainly used in the liquid crystal display device.

Generally, the liquid crystal display device comprises a liquid crystal panel comprising liquid crystals injected onto upper and lower substrates and between the upper and lower substrates, a driving circuit for driving the liquid crystal panel, and a backlight for providing the liquid crystals with white light. The liquid crystal display device is divided into two types of liquid crystal displays, those employing an R, G and B color filter and those employing a color field sequential arrangement for displaying color images.

The color filter driving type liquid crystal display is constructed in such a manner that one pixel is divided into R, G and B sub-pixels, and R, G and B color filters are aligned on each R, G and B sub-pixels so as to display a color shape by transmitting light from one backlight to the R, G and B color filters through liquid crystals.

The color field sequential driving type liquid crystal display obtains a full color image by lighting independent light sources of respective R, G and B colors sequentially and periodically, and by applying corresponding color signals to the respective pixels while being synchronized with lighting cycles of the light sources. Namely, the color field sequential driving type liquid crystal display is constructed in such a manner that R, G and B backlights are aligned in one pixel that is not divided into R, G and B sub-pixels so as to display a color shape using persistence of vision of eyes by sequentially displaying light of R, G and B colors that are the three primary colors on one pixel through liquid crystals from R, G and B backlights in a time-sharing manner.

Therefore, the color field sequential driving type liquid crystal display achieves very large scale integration (VLSI) since only one third of the number of pixels are required in the color field sequential driving type liquid crystal while maintaining the same resolution as in the color filter type liquid crystal display, and the color field sequential driving type liquid crystal display has the advantage of being able to realize the same color reproducibility and high speed moving images as color televisions are able to realize.

The color field sequential driving type liquid crystal display is driven with one frame being divided into three sub-frames since the color field sequential driving type liquid crystal display displays a color shape by synthesizing lights of R, G and B primary colors. In addition, driving times of R, G and B backlights for one pixel are varied differently from those in a color filter type liquid crystal display in which lights are sequentially scanned from an upper part of a screen to a lower part of the screen.

Furthermore, one frame is divided into an R sub-frame for displaying an R color, a G sub-frame for displaying a G color, and a B sub-frame for displaying a B color. That is, the R sub-frame displays the R color by driving an R backlight, the G sub-frame displays the G color by driving a G backlight, and the B sub-frame displays the B color by driving a B backlight. Therefore, one frame is divided into respective sub-frames for displaying R, G and B colors and has three sub-frame sections sequentially emitted through R, G and B backlights.

The color field sequential driving type liquid crystal display has an advantage in that it enables about three times the resolution to be realized on the same sized panel compared with the color filter driving type liquid crystal display, and its light efficiency is increased since color filters are not used. On the other hand, the color field sequential driving type liquid crystal display needs high speed movement characteristics that require a driving frequency as high as six or more times that of the color filter driving type liquid crystal display since the color field sequential driving type liquid crystal display is driven with one frame being divided into three sub-frames.

Since liquid crystals are degraded due to their characteristics when they are continuously driven by voltages of the same polarity, the liquid crystals should be driven by voltages of opposite polarities. Therefore, if a voltage of positive polarity is impressed on an arbitrary one pixel, a voltage of negative polarity should be impressed on the pixel in the next frame so as to drive the pixel.

Conventional liquid crystal displays are characterized by the following problems, which are overcome by the present invention.

Such liquid crystal display devices generate black points, caused by blackening phenomena, and blinking pixels, so that the image quality of the liquid crystal display panel deteriorates, and the life of the liquid crystal display panel is shortened due to ripple voltages generated by a common electrode of a common substrate.

SUMMARY OF THE INVENTION

Therefore, in order to solve the foregoing problems of the prior art, it is an object of the present invention to provide a liquid crystal display device with a feedback circuit part which compensates for ripple voltages generated by a common electrode of a common substrate.

In order to achieve the foregoing object, the present invention provides a liquid crystal display device, comprising: a liquid crystal display panel including an array substrate on which a plurality of data lines and a plurality of scan lines are aligned, a common substrate, and liquid crystals interposed between the array substrate and the common substrate; a power supply part which generates a power supply voltage, and which produces a common power supply voltage to emit the liquid crystals of the liquid crystal display panel; and a feedback circuit part connected between a common electrode of the common substrate and the power supply part.

Furthermore, the present invention provides a liquid crystal display device, comprising: a liquid crystal display panel including an array substrate on which a plurality of data lines and a plurality of scan lines are aligned, a common substrate, and liquid crystals interposed between the array substrate and the common substrate; a common power supply which generates a power supply voltage, and which produces a common power supply voltage to emit the liquid crystals of the liquid crystal display panel; and a feedback circuit part which is equipped with a low-pass filter part for receiving a third ripple voltage generated from a common electrode of the common substrate, a negative feedback part for producing a first ripple voltage that inverts the third ripple voltage by feed backing the third ripple voltage through first and second impedances, and a buffer part for receiving the first ripple voltage and producing a second ripple voltage through buffering, and which receives the common power supply.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
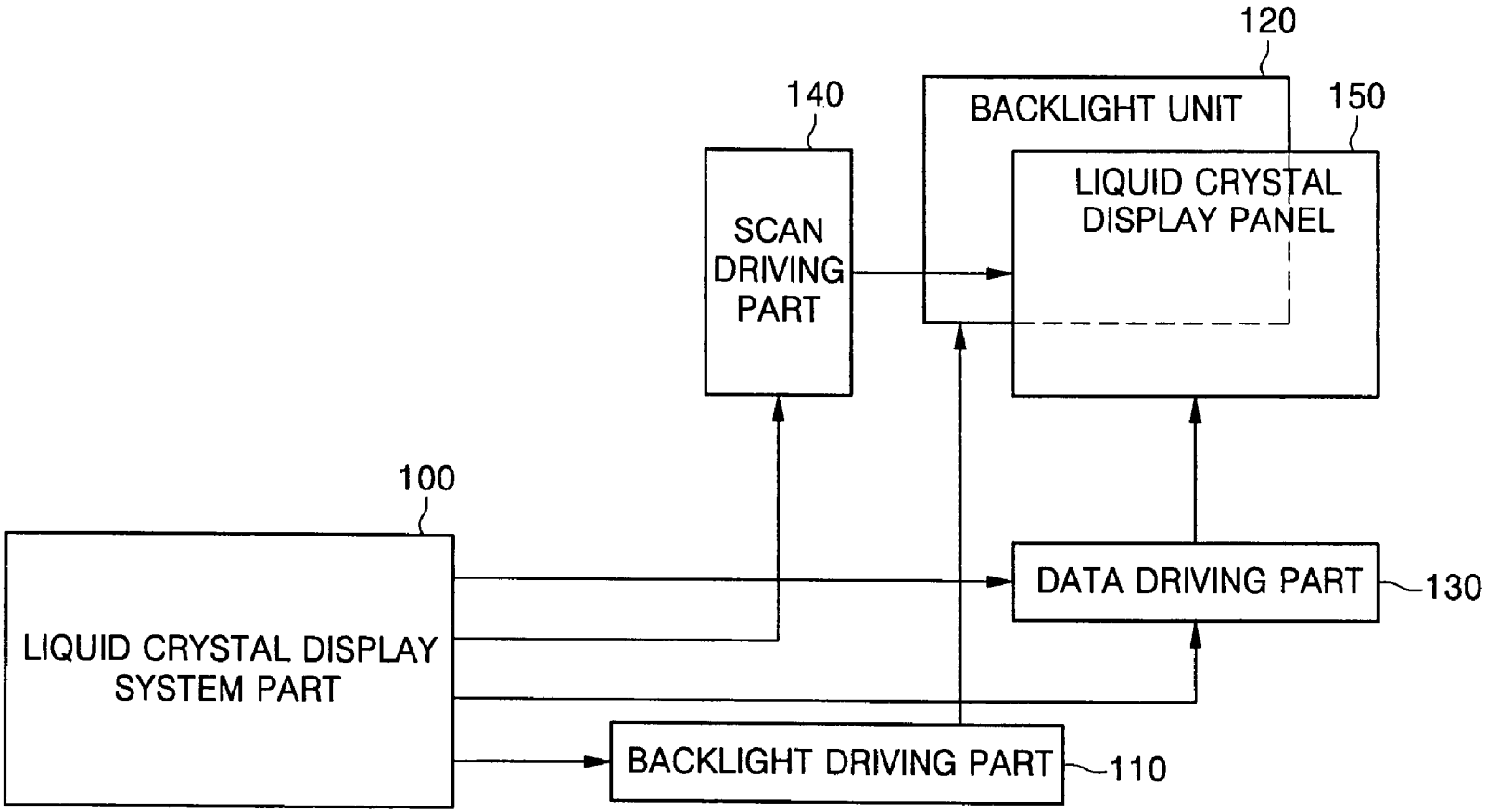
FIG. 1 is a block diagram of a liquid crystal display device.

FIG. 1 is a block diagram of a liquid crystal display device.

Referring to FIG. 1, a liquid crystal display device comprises a liquid crystal display system part 100, a backlight driving part 110, a backlight unit 120, a data driving part 130, a scan driving part 140 and a liquid crystal display panel 150.

The liquid crystal display system part 100 is internally comprises a power supply part, a control part, a data conversion part, a memory part, and a buffer part.

The power supply part supplies a prescribed power supply voltage to operate respective circuit parts of the liquid crystal display system part 100.

Furthermore, the control part processes and controls the produced signals by producing a write command signal, a read command signal and a timing control signal, which are control signals for controlling prescribed signal information in the respective circuit parts of the liquid crystal display system part 100.

In addition, the data conversion part is a circuit part operated under the control of the control part, and image data produced by the data conversion part are converted into red (R), green (G) and blue (B) data which are digital data, the converted data being transmitted to the memory part.

The memory part stores the red (R), green (G) and blue (B) data in response to a write commend signal from the control part. In addition, the red (R), green (G) and blue (B) data are transmitted to the buffer part in response to a read command signal from the control part.

Furthermore, the buffer part inputs the red (R), green (G) and blue (B) data, transmitted in serial form from the memory part, into the data driving part 130. Since the buffer part does not have to exist, the red (R), green (G) and blue (B) data can be directly transmitted from the memory part to the data driving part 130.

The backlight driving part 110 comprises a driving voltage generation part and a pulse width modulation (PWM) signal generation part. The driving voltage generation part generates forward driving voltages RVf, GVf and BVf suitable for the backlight unit 120 by inputting driving conditions related to luminance of the backlight and provided by the liquid crystal display system part 100. That is, the backlight driving part 110 transfers the generated forward driving voltages to the backlight unit 120 so that the backlight unit 120 is driven by the forward driving voltages after receiving a prescribed control signal from the liquid crystal display system part 100. The PWM signal generation part sequentially generates PWM signals RPWM, GPWM and BPWM suitable for R, G and B light emitting diodes, respectively, of the backlight unit 120 by inputting driving conditions related to chrominance of the backlight unit 120 and provided by the liquid crystal display system part 100.

The backlight unit 120 comprises R, G and B light emitting diodes (LEDs), a mold frame, a reflection sheet, a light guide plate, a diffusion sheet, a prism sheet, and a protection sheet. The R, G and B LEDs are parts which first emit light, the R, G and B LEDs being small light sources which are widely used semipermanently in information appliances and small portable terminals. The R, G and B LEDs are driven by the forward driving voltages RVf, GVf and BVf, respectively, and the PWM signals RPWM, GPWM and BPWM, respectively, provided by the backlight driving part 110 so as to emit R, G and B lights, respectively, having prescribed luminance and chrominance.

The mold frame maintains the backlight unit 120 in such a condition that R, G, B and W LEDs, the reflection sheet, the light guide plate, the diffusion sheet, the prism sheet and the protection sheet are assembled in the backlight unit 120.

The reflection sheet increases overall luminance, and prevents loss of light transmitted by the rear surface of the light guide plate by reflecting light toward the front surface of the light guide plate, the lights emanating from a lower part of the light guide plate by means of the light guide plate constituting the total reflection of light from the LEDs.

The light guide plate is a component for guiding the light toward the front side by evenly transmitting light from the LEDs onto a two-dimensional plane. The light guide plate has an improved efficiency due to specific patterns printed on the surface of the light guide plate so that it carries out the functions of the light guide plate.

The light guide plate is formed of a transparent acryl-resin that is light and not easily broken or deformed due to its high strength, and it has a high visible light transmittance.

The diffusion sheet prevents the patterns of the light guide plate from being visible, thereby further rendering the light emitted from the light guide plate uniform and smoothly treating the light as a whole.

Mountain-shaped fine pitches are formed on the prism sheet in such a way that the lower sides of the fine pitches are vertical, and the upper sides of the fine pitches are horizontal so as to increase the luminance by refracting and collecting light when the diffusion sheet decreases luminance. The prism sheet forms one set composed of one vertical sheet and one horizontal sheet. That is, the prism sheet plays a role in increasing front luminance by constantly changing the direction of light emanating from various angles to the pitch and angle of a prism shape.

The protection sheet is formed on the prism sheet as a protection film for preventing an external impact from being impressed on the backlight unit 120, and for preventing contamination caused by inflow of alien substances. Furthermore, the protection sheet is used to prevent flaws from being formed on the prism sheet, and to prevent Moire phenomena from being generated when one set of horizontal and vertical prism sheets is used. Furthermore, the protection sheet functions to widen a viewing angle narrowed by the prism sheet. However, the protection sheet does not seem to be used since the function of the prism sheet has been improved very much lately.

The data driving part 130 transmits the color data to a plurality of data lines of the liquid crystal display panel 150 by sequentially receiving prescribed serial type R, G and B color data from the liquid crystal display system part 100.

The scan driving part 140 transmits a timing control signal to a plurality of scan lines of the liquid crystal display panel 150 by receiving a timing control signal transmitted by the liquid crystal display system part 100.

An additional device for lightening the screen of a liquid crystal display by installing a light source on the backside of the liquid crystal display panel is required since the liquid crystals are passive display devices that cannot be emitted themselves although liquid crystals installed on the liquid crystal display panel 150 are display devices for a variety of information. That is, the liquid crystals are emitted by receiving light transmitted by the backlight unit 120. The liquid crystal display panel 150 comprises a plurality of pixels aligned in column and row fashion, and a plurality of scan lines for selecting the plurality of pixels. Furthermore, the liquid crystal display panel 150 is formed in such a way that a plurality of data lines for transferring a gradation data voltage and a reset voltage corresponding to gradation data are insulated with respect to the plurality of scan lines, and cross the plurality of scan lines. The scan lines and the data lines respectively surround the plurality of pixels aligned in a column and row fashion. Each of the pixels comprises a thin film transistor in which a gate electrode and a source electrode are connected to the scan lines and the data lines, and in which a pixel capacitor and a storage capacitor are connected to the drain electrode of the thin film transistor.

Therefore, the liquid crystal display panel 150 comprises an array substrate on which a plurality of data lines and scan lines are regularly aligned, liquid crystals that are passive devices, and a common substrate from which the liquid crystals are emitted. The common substrate is connected to a common electrode so that the liquid crystals are emitted, and the common substrate receives a prescribed voltage from the data driving part 130 or the scan driving part 140.

The present invention will now be described in detail in connection with a preferred embodiment and with reference to the accompanying drawings. For reference, like reference characters designate corresponding parts throughout several views.

Figure 2:
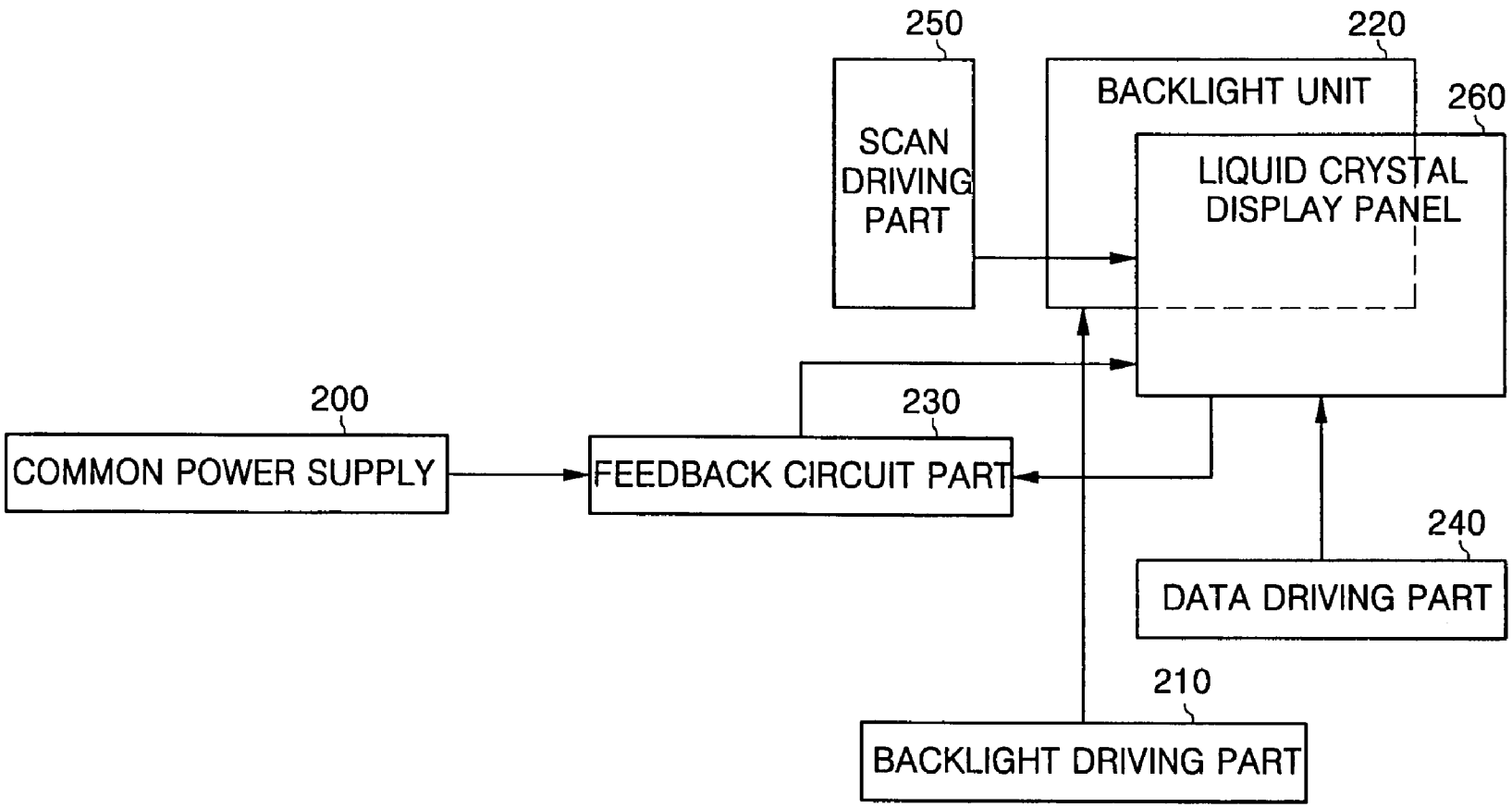
FIG. 2 is a block diagram of a liquid crystal display device having a feedback circuit part according to a preferred embodiment of the present invention.

FIG. 2 is a diagram of a liquid crystal display device having a feedback circuit part according to a preferred embodiment of the present invention.

Referring to FIG. 2, the liquid crystal display device (LCD) comprises a common power supply 200, a backlight driving part 210, a backlight unit 220, a feedback circuit part 230, a data driving part 240, a scan driving part 250, and a liquid crystal display panel 260.

The common power supply 200 provides the feedback circuit part 230 with a common power supply voltage Vcom so that the feedback circuit part 230 operates.

The backlight driving part 210 comprises a driving voltage generation part and a PWM (pulse width modulation) signal generation part. The driving voltage generation part generates forward driving voltages RVf, GVf and BVf suitable for the backlight unit 220 by inputting driving conditions related to luminance of the backlight. That is, after receiving a prescribed driving control signal, the backlight driving part 210 generates and transmits the forward driving voltages to the backlight unit 220 so that the backlight unit 220 is driven. The PWM signal generation part sequentially generates PWM signals RPWM, GPWM and BPWM suitable for R, G and B light emitting diodes, respectively, of the backlight unit 220 by inputting driving conditions related to chrominance of the backlight unit 220.

The backlight unit 220 comprises R, G and B light emitting diodes (LEDs) from which light of three primary colors R, G and B, respectively, selected from a liquid crystal display portion are sequentially emitted, and backlight unit 220 further comprises a mold frame, a reflection sheet, a light guide plate, a diffusion sheet, a prism sheet and a protection sheet (not shown).

The R, G and B LEDs comprise an R LED for emitting an R light, a G LED for emitting a G light and a B LED for emitting a B light so as to sequentially provide the lights to a display portion. The R, G and B LEDs are driven by the forward driving voltages RVf, GVf and BVf, respectively, and the PWM signals RPWM, GPWM and BPWM, respectively, provided by the backlight driving part 210 to selectively emit R, G and B light, respectively, having prescribed luminance and chrominance.

The mold frame maintains the backlight unit 220 in such a condition that the R, G and B LEDs, the reflection sheet, the light guide plate, the diffusion sheet, the prism sheet and the protection sheet are assembled in the backlight unit 220.

The reflection sheet increases overall luminance and prevents loss of light transmitted from the rear surface of the light guide plate by reflecting light toward the front surface of the light guide plate, the light emanating from a lower part of the light guide plate by means of the light guide plate constituting the total reflection of light from the LEDs.

The light guide plate is a component for guiding the light toward the front side by evenly transmitting light emanating from the LEDs onto a two-dimensional plane. The light guide plate has an improved efficiency due to specific patterns printed on the surface of the light guide plate so as to carry out the function of the light guide plate.

The light guide plate is formed of a transparent acryl resin that is light and not easily broken or deformed due to its high strength, and it has a high visible light transmittance.

The diffusion sheet prevents the patterns of the light guide plate from being visible so as to render light emitted from the light guide plate uniform, and so as to smoothly treat the light as a whole.

Mountain-shaped fine pitches are formed on the prism sheet in such a way that the lower sides of the fine pitches are vertical, and the upper sides of the fine pitches are horizontal so as to increase the luminance by refracting and collecting light when the diffusion sheet decreases luminance. Generally, the prism sheet forms one set composed of a vertical prism and a horizontal prism. That is, the prism sheet increases the front luminance of R, G and B light coming from various angles by controlling the pitch and angle of a prism shape in a certain direction.

The protection sheet is formed on the prism sheet as a protection film for preventing an external impact from being impressed on the backlight unit 220, and for preventing contamination caused by inflow of alien substances. Furthermore, the protection sheet prevents flaws from being formed on the prism sheet, and to prevent Moire phenomena from being generated when one set of prism sheets is used. Furthermore, the protection sheet functions to widen a viewing angle narrowed by the prism sheet. However, a separate protection sheet does not have to be used since the function of the prism sheet has been improved very much lately.

The feedback circuit part 230 is mounted on the liquid crystal display device to compensate for distortion components coming out of a common substrate of the liquid crystal display panel 260. The feedback circuit part 230 comprises a negative feedback part, a buffer part and a low-pass filter part (not shown). That is, the liquid crystal display device improves picture quality of the liquid crystal display panel 260 and prevents aging of the liquid crystal display panel 260 by including the feedback circuit part 230.

The data driving part 240 transmits the color data to a plurality of data lines of the liquid crystal display panel 260 by sequentially receiving prescribed serial type R, G and B color data.

The scan driving part 250 controls a plurality of pixels by selectively receiving a prescribed timing control signal and transmitting the timing control signal to a plurality of scan lines of the liquid crystal display panel 260.

An additional device for lightening the screen of the liquid crystal display device by installing a light source on the backside of the liquid crystal display panel is required since the liquid crystals are passive display devices that cannot be emitted themselves, although liquid crystals of the liquid crystal display panel 260 are display devices for a variety of information. That is, the liquid crystals are emitted by receiving light transmitted by the backlight unit 220. Furthermore, the liquid crystal display panel 260 comprises a plurality of pixels aligned in column and row fashion and a plurality of scan lines for selecting the plurality of pixels. The liquid crystal display panel 260 is formed in such a way that a plurality of data lines for transferring a reset voltage and a gradation data voltage corresponding to gradation data are insulated with respect to the plurality of scan lines, and cross the plurality of scan lines. The scan lines and the data lines respectively surround the plurality of pixels aligned in a column and row fashion.

Each of the pixels comprises a thin film transistor in which a gate electrode and a source electrode are connected to the scan lines and the data lines, and in which a pixel capacitor and a storage capacitor are connected to the drain electrode of the thin film transistor.

Liquid crystals used in the liquid crystal display panel 260 have both crystal characteristics and liquid characteristics, and include thermotropic liquid crystals and lyotropic liquid crystals.

Figure 3A:
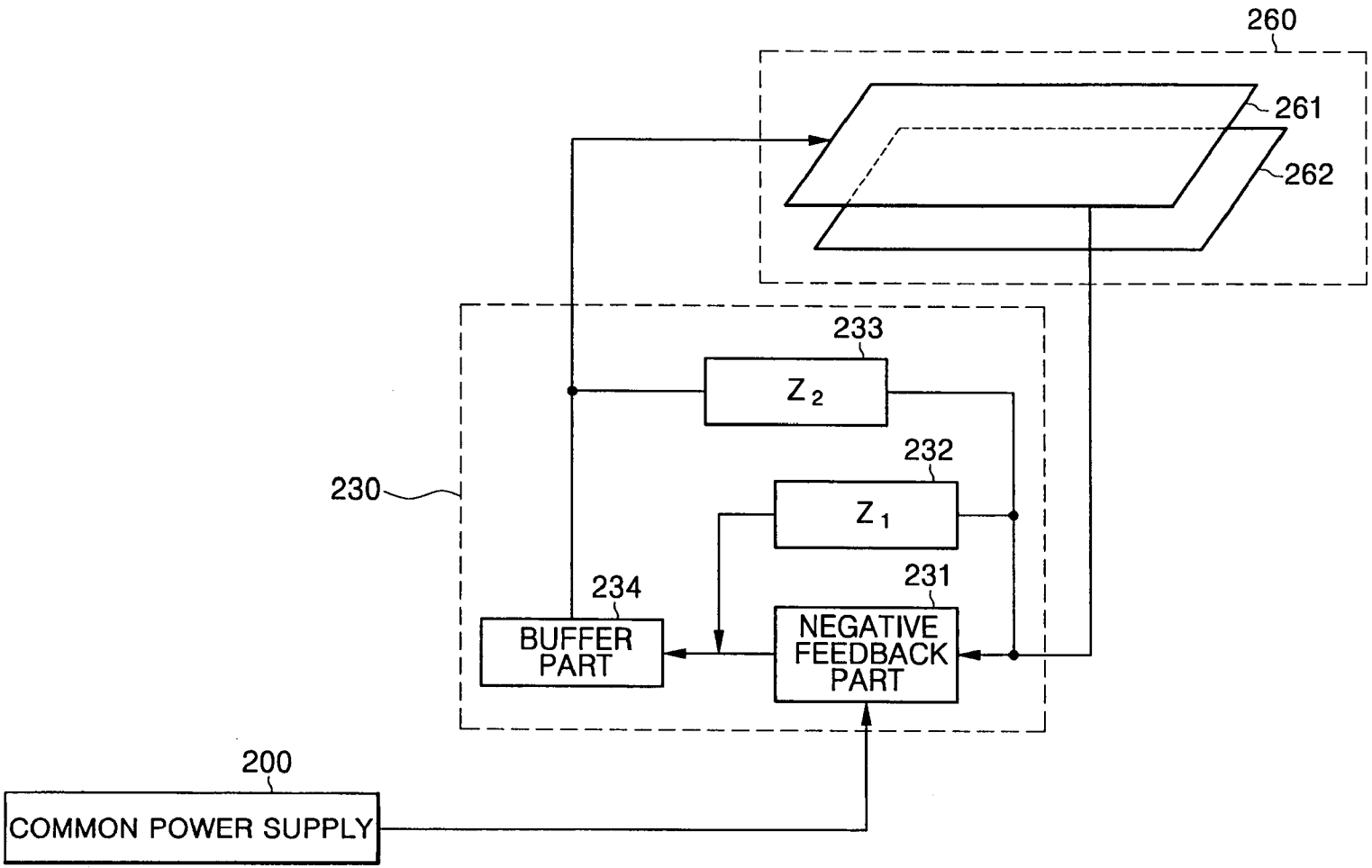
FIG. 3A and FIG. 3B are schematic diagrams of a feedback circuit part in a liquid crystal display device according to the preferred embodiment of the present invention.
Figure 3B:
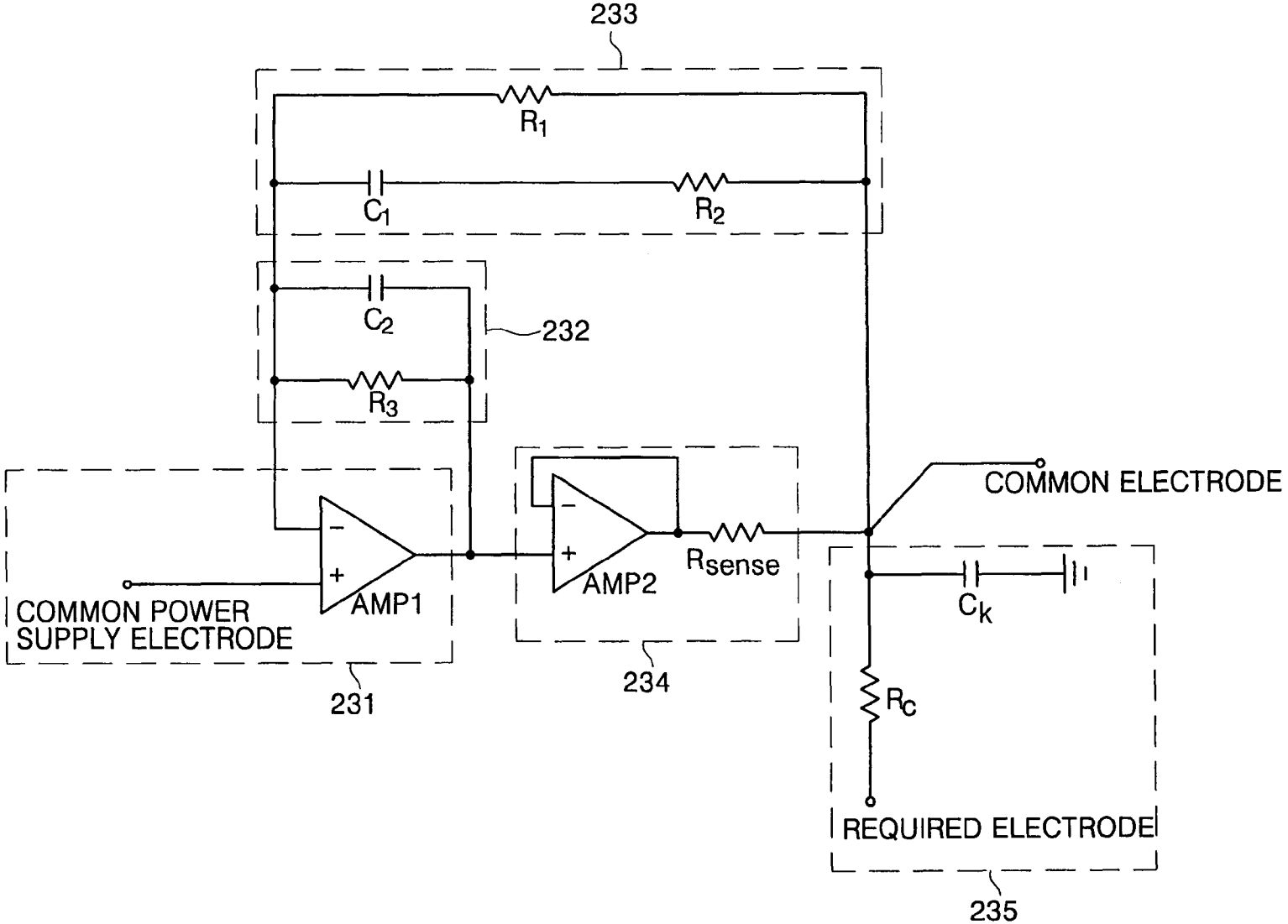

FIG. 3A and FIG. 3B are schematic diagrams of a feedback circuit part in a liquid crystal display according to the preferred embodiment of the present invention.

Referring to FIG. 3A, a liquid crystal display panel 260 of a liquid crystal display device comprises an array substrate 262 on which a plurality of data lines and scan lines are regularly aligned, liquid crystals (not shown) that are passive devices, and a common substrate 261 for emitting the liquid crystals and thereby displaying the emitted liquid crystals. That is, after receiving a prescribed power supply voltage, the liquid crystal display panel 260 emits light and generates ripple voltages that are distortion components, from a common electrode (not shown) of the common substrate 261. Furthermore, in order to compensate for the ripple voltages, the common electrode (which is a ground electrode) receives a common power supply voltage Vcom produced by the common power supply 200 and is connected to a sensing electrode of the feedback circuit part 230.

The distortion components are typically referred to as the ripple voltages. That is, examples of the ripple voltages include a half-wave rectification voltage, a full-wave rectification voltage rectified by a rectifier, and a voltage in which alternating current is placed over direct current. Ripple voltages are pulses, and the ripple voltages are said to be pulsating voltages in which alternating components remaining in a rectifier power supply overlap with the direct current output.

Referring to FIG. 3A and FIG. 3B, a feedback circuit part of the liquid crystal display is a circuit part for effectively compensating for ripple voltages which are the distortion components. The feedback circuit part comprises a negative feedback part 231, a buffer part 234 and a low-pass filter part 235.

The low-pass filter part 235 is not necessarily an essential constituent, although it can be included in the structure of the feedback circuit part. Furthermore, impedance (Z1) 232 and impedance (Z2) 233 are also not necessarily essential constituents of the feedback circuit part. However, the feedback circuit part operates more easily by including the low-pass filter part 235, the impedance (Z1) 232 and the impedance (Z2) 233.

The preferred embodiment of the present invention is designed by including the low-pass filter part 235 as a constituent of the feedback circuit part.

The negative feedback part 231 comprises a common power supply electrode and a first operational amplifier AMP1. That is, when constructing the impedance (Z1) 232 with resistor R3 and a capacitor C2, an inverting input terminal (−) and an output terminal of the first operational amplifier AMP1 are individually connected in parallel with the resistor R3 and the capacitor C2. Furthermore, a noninverting input terminal (+) of the first operational amplifier AMP1 is connected to the common power supply electrode.

The negative feedback part 231 reduces the sensitivity of gain, nonlinear distortion and noise, it controls input impedance and output impedance, and it extends bandwidth.

Furthermore, according to formation of a virtual short circuit relationship between the noninverting input terminal (+) of the first operational amplifier AMP1 and the inverting input terminal (−) thereof, the noninverting input terminal (+) transfers a common power supply voltage Vcom provided by the common power supply electrode to the inverting input terminal (−). The resistor R3 and the capacitor C2 receive the common power supply voltage Vcom from the inverting input terminal (−). That is, the output terminal of the first operational amplifier AMP1 generates current I1 and a first ripple voltage Vin1, the phase of which is reversed by being subjected to the influence of the common power supply voltage Vcom, the resistor R3 or the capacitor C2. The resistor R3 and the capacitor C2 can be simplified as represented in the following mathematical equation 1 since they are connected to each other in a row:

$$Z_1 = \frac{1 + sC_2R_3}{R_3} \qquad \text{[Mathematical Equation 1]}$$

Therefore, the first ripple voltage Vin1 is represented by the following mathematical equation 2:

$$V_{in1}=V_{com}-I_1Z_1$$ [Mathematical Equation 2]

A buffer amplifier, which is the second operational amplifier AMP2, forms a buffer part 234 connected to the negative feedback part 231.

Generally, a buffer amplifier is an amplifier having a local purpose of adjusting a certain signal level. The buffer amplifier is originally used to prevent disharmony between circuit stages, wherein respective circuits are connected to each other to sufficiently display their own performances.

Ultimately, the buffer amplifier is an amplifier with a buffer action additionally attached to the front or rear of a relevant stage of circuits to prevent misoperation of the circuits caused when an input signal is not properly received in the circuits of a next stage. For example, there are frequent occasions when the power level of an output is low when a passive mixer is used. The buffer amplifier is attached to an input or to an output to control the power level so that it is limited to a certain level. That is, when oscillatory frequency power is not satisfactory in the case of a voltage controlled oscillator (VCO), the buffer amplifier is used in the output for the simple purpose of increasing a value of the oscillatory frequency power. The buffer amplifier is called an amplifier because it is used for the purpose of increasing the signal level when the signal level is lowered, and whether the buffer amplifier should be used or not is determined according to the performance of a principal circuit. Generally, the buffer amplifier is designed to have such a specification that a desired gain is obtained by suppressing noise as much as possible.

Accordingly, the negative feedback part 231 outputs the first ripple voltage Vin1 and the buffer part 234 outputs a second ripple voltage Vin2 after receiving the first ripple voltage Vin1, as represented by the following mathematical equation 3:

$$V_{in1}=V_{in2}$$ [Mathematical Equation 3]

The low-pass filter part 235 receives the second ripple voltage Vin2 from a resistor Rsense provided in the buffer part 234, and offsets or filters high frequency components of the second ripple voltage to produce a voltage for compensation. Furthermore, the low-pass filter part 235 transfers the third ripple voltage to the negative feedback part 231 through impedance (Z1) 232 and impedance (Z2) 233 by feeding back the third ripple voltage produced from common substrate 261.

Generally, the low-pass filter part 235 comprises resistor Rc and capacitor $C_R$, and is used in such a manner that the resistor Rc and the capacitor $C_R$ are connected in series to a single source, and an output is extracted from both ends of the capacitor $C_R$. In this case, the transfer function of the output signal/input signal is $1/(1+jwRcC_R)$, where j indicates a complex number (the square root of −1), and w is frequency expressed in radians/second. The magnitude of the transfer function corresponds to the gain of the filter, and is represented in the following mathematical equation 4:

$$\text{Gain} = \frac{1}{\sqrt{1 + w^2 R_C^2 C_k^2}}$$ [Mathematical Equation 4]

As shown in the above mathematical equation 4, the more the frequency w is increased, the more the gain is decreased since the denominator is gradually increased.

On the other hand, it can be seen that the gain becomes 1 since w is 0 in the case of a direct current signal. Namely, a gain near 1 is obtained for low frequency components, but the gain is rapidly reduced when frequency is increased in the case of high frequency components. These characteristics are called low-pass characteristics. Values of the resistor Rc and the capacitor Ck are controlled so as to determine that the low-pass filter part 235 roughly passes components of up to a prescribed frequency, and filters components of the prescribed frequency or more. Furthermore, high frequency components filtered by the low-pass filter part 235 are consumed in the resistor Rc.

Therefore, the low-pass filter part 235 comprises a resistor Rc and a capacitor Ck, the resistor Rc is connected to a required electrode to receive a prescribed required voltage Vs, and the capacitor Ck is connected to the resistor $R_C$ and to the resistor Rsense. The resistor Rsense is series-connected to an output terminal of the amplifier AMP2 in buffer part 234. A common electrode of the common substrate 261 is connected to the low-pass filter part 235 to produce a voltage for compensation Vout.

Impedance Z3, which is a transfer function of output signal/input signal for the low-pass filter part 235, is represented by the following mathematical equation 5:

$$Z_3 = \frac{1}{(1 + sR_cC_k)}$$ [Mathematical Equation 5]

Furthermore, by applying the mathematical equation 5, the low-pass filter part 235 receives the second ripple voltage Vin2 transferred from the output terminal of the buffer part 234 (the output of resistor Rsense), and produces a voltage for compensation Vout that removes the high frequency components. Furthermore, the voltage for compensation Vout is fed back to the negative feedback part 231 by the low-pass filter part 235, an electric current I3 fed back to the negative feedback part 231 being formulated as represented by the following mathematical equation 6:

$$I_3 = \frac{V_{in1} - V_{out}}{R_{sense}} + \frac{V_s - V_{out}}{Z_3}$$ [Mathematical Equation 6]

Furthermore, equivalence is effected between the currents I1 and the I3, and resistors R1 and R2 and capacitor C1 are designed between the negative feedback part 231 and the low-pass filter part 235 according to the construction of feedback circuits from the low-pass filter part 235 to the negative feedback part 231 in the feedback circuit part.

That is, the resistor R2 and the capacitor C1 are connected to each other in series, and are connected to the resistor R1 to form impedance (Z2) 233. The resistor R1 is connected in series between the negative feedback part 231 and the low-pass filter part 235, the resistor R2 is series-connected to the low-pass filter part 235, and the capacitor C1 is series-connected to the negative feedback part 231.

The impedance (Z2) 233 is represented by the following mathematical equation 7:

$$Z_2 = \frac{sC_1(R_1 + R_2) + 1}{R_1(sC_1R_2 + 1)}$$ [Mathematical Equation 7]

Therefore, current I2 flows through the impedance (Z2) 233, and is represented by the following mathematical equation 8 due to the feedback structure of the feedback circuit part extending from the low-pass filter part 235 to the negative feedback part 231:

$$I_2 = \frac{V_{out} - V_{com}}{Z_2} \quad \text{[Mathematical Equation 8]}$$

Furthermore, the current I2 has the same value as the current I1, and has the same value as the current I3 as well. A third ripple voltage fed back from the low-pass filter part 235 to the negative feedback part 231 has the same value as the first ripple voltage.

That is, the first ripple voltage is represented by the following mathematical equation 9 by establishing the current I1 from the mathematical equation 2 and the current I2 from the mathematical equation 8 to be equivalent to each other:

$$\frac{V_{com} - V_{in1}}{Z_1} = \frac{V_{out} - V_{com}}{Z_2} \quad \text{[Mathematical Equation 9]}$$

Namely, $$V_{in1} = \frac{V_{com}(Z_1 + Z_2) - Z_1 V_{out}}{Z_2}$$

The voltage for compensation Vout, represented by the following mathematical equation 10, is obtained since the principle of equivalence is effected in the mathematical equation 2 and the mathematical equation 6:

$$\frac{V_{com} - V_{in1}}{Z_1} = \frac{V_{in1} - V_{out}}{R_{sense}} + \frac{V_s - V_{out}}{Z_3} \quad \text{[Mathematical Equation 10]}$$

Namely, $$V_{out} = \frac{Z_3 V_{in1}(R_{sense} + Z_1) + Z_1 V_s R_{sense}}{Z_1 R_{sense}}$$

Finally, the voltage for compensation Vout, as represented in the following mathematical equation 11, can be obtained by substituting the mathematical equation 9 for the mathematical equation 10:

$$V_{out} = \frac{Z_3 V_{com}(Z_1 + Z_2)(R_{sense} + Z_1) + Z_1 Z_2 V_s R_{sense}}{Z_1 Z_3 (R_{sense} + Z_1) + Z_1 Z_2 R_{sense}} \quad \text{[Mathematical Equation 11]}$$

That is, the voltage for compensation Vout according to the mathematical equation 11 is a final voltage value produced by the feedback circuit part to compensate for the first ripple voltage generated by the common electrode of the common substrate 261. Furthermore, the voltage for compensation Vout compensates for the first ripple voltage, which is a distortion component, and removes unnecessary high frequency components so that liquid crystals of the liquid crystal display panel are smoothly emitted.

Those skilled in the art are effectively capable of adjusting and controlling the voltage for compensation Vout so as to compensate for the ripple voltages since the voltage for compensation Vout, according to preferred embodiments of the present invention, has parameters of the resistors R1, R2, R3, Rsense and Rc, the capacitors C1, C2 and Ck, or the common power supply voltage Vcom provided in the feedback circuit part as they are, wherein the ripple voltages are the first ripple voltage, the second ripple voltage and the third ripple voltage.

As described above, a liquid crystal display device with a feedback circuit part obtains the effect of compensating for ripple voltages generated from the common electrode of the common substrate 261, and preventing the generation of black points or blinking pixels.

While the invention has been particularly shown and described with reference to a preferred embodiment thereof, it will be understood by those skilled in the art that the foregoing and other changes in form and detail may be made therein without departing from the spirit and scope of the invention.

What is claimed is:

1. A liquid crystal display device, comprising:

a liquid crystal display panel including an array substrate on which a plurality of data lines and a plurality of scan lines are aligned, a common substrate having a common electrode, and liquid crystals interposed between the array substrate and the common substrate;

a power supply part for generating a power supply voltage, and for producing a common power supply voltage; and a feedback circuit part connected between the power supply part and the common electrode of the common substrate;

wherein the feedback circuit part comprises a negative feedback part having a first input connected to the power supply part and having an output, a buffer part having an input connected to the output of the negative feedback part and having an output connected to the common electrode of the common substrate, a low-pass filter part connected to a junction between the output of the buffer part and the common electrode of the common substrate for receiving a third ripple voltage from the common electrode, a first impedance, and a second impedance;

said first impedance being connected between the output of the negative feedback part and a second input of the negative feedback part; and said second impedance being connected directly between the output of the buffer part and the second input of the negative feedback part.

2. The liquid crystal display device according to claim 1, wherein said negative feedback part produces a first ripple voltage which represents an inversion of the third ripple voltage due to feeding back of the third ripple voltage through the first and second impedances; and wherein the buffer part receives the first ripple voltage of the negative feedback part, and produces a second ripple voltage through buffering.

3. The liquid crystal display device according to claim 2, wherein the first ripple voltage, the second ripple voltage and the third ripple voltage are distortion components.

4. The liquid crystal display device according to claim 1, wherein the first impedance is an alternating current network in which a third resistor and a second capacitor are connected in parallel.

5. The liquid crystal display device according to claim 4, wherein the second impedance is an alternating current network comprising a first capacitor and a second resistor connected in series, and a first resistor connected in parallel with the first capacitor and the second resistor.

6. The liquid crystal display device according to claim 5, wherein the low-pass filter part produces a compensation voltage by removing high frequency components of the third ripple voltage.

7. The liquid crystal display device according to claim 6, wherein the negative feedback part comprises a first operation amplifier connected in series with the first impedance, and a common power supply electrode for receiving the common power supply voltage provided by the power supply part.

8. The liquid crystal display device according to claim 7, wherein the buffer part includes a buffer amplifier comprising a second operational amplifier connected in series with the negative feedback part, and a fourth resistor connected in series with the buffer amplifier.

9. The liquid crystal display device according to claim 8, wherein the low-pass filter part comprises a fifth resistor connected in series with the fourth resistor of the buffer part, a required electrode which is connected in series with the fifth resistor, a required voltage being supplied to the required electrode, the common electrode of the common substrate being connected in series with the fifth resistor, and a third capacitor being connected in parallel with the fifth resistor.

10. The liquid crystal display device according to claim 9, wherein the required voltage is provided by the power supply part.

11. The liquid crystal display device according to claim 9, wherein the compensation voltage is a voltage value that can be changed and controlled by adjusting at least one of the first resistor, the second resistor, the third resistor, the fourth resistor, the fifth resistor, the first capacitor, the second capacitor, the third capacitor and the common power supply voltage.

12. The liquid crystal display device according to claim 9, wherein the common electrode comprises a ground electrode.

13. The liquid crystal display device according to claim 1, wherein the liquid crystals are one of thermotropic liquid crystals and lyotropic liquid crystals.

14. A liquid crystal display device, comprising:

a liquid crystal display panel including an array substrate on which a plurality of data lines and a plurality of scan lines are aligned, a common substrate having a common electrode, and liquid crystals interposed between the array substrate and the common substrate;

a common power supply for generating a power supply voltage, and for producing a common power supply voltage; and a feedback circuit part connected between the power supply part and the common electrode of the common substrate;

wherein the feedback circuit part comprises a negative feedback part having a first input connected to the power supply part and having an output, a buffer part having an input connected to the output of the negative feedback part and having an output connected to the common electrode of the common substrate, a low-pass filter part connected to a junction between the output of the buffer part and the common electrode of the common substrate for receiving a third ripple voltage from the common electrode, a first impedance, and a second impedance;

said first impedance being connected between the output of the negative feedback part and a second input of the negative feedback part; and said second impedance being connected directly between the output of the buffer part and the second input of the negative feedback part.

15. The liquid crystal display device according to claim 14, wherein the liquid crystals are one of thermotropic liquid crystals and lyotropic liquid crystals.

16. The liquid crystal display device according to claim 14, wherein the first impedance is an alternating current network in which a third resistor and a second capacitor are connected in parallel.

17. The liquid crystal display device according to claim 14, wherein the second impedance is an alternating current network comprising a first capacitor and a second resistor connected in series, and a first resistor connected in parallel with the first capacitor and the second resistor.

18. The liquid crystal display device according to claim 14, wherein the low-pass filter part produces a compensation voltage by removing high frequency components of the third ripple voltage.

19. The liquid crystal display device according to claim 14, wherein the negative feedback part comprises a first operation amplifier connected in series with the first impedance, and a common power supply electrode for receiving the common power supply voltage provided by the power supply part.

20. The liquid crystal display device according to claim 14, wherein the negative feedback part produces a first ripple voltage which represents an inversion of the third ripple voltage by feeding back the third ripple voltage through the first and second impedances, and wherein the buffer part receives a first ripple voltage from the negative feedback part and produces a second ripple voltage through buffering, and the negative feedback part receives the common power supply voltage.

21. The liquid crystal display device according to claim 20, wherein the first ripple voltage, the second ripple voltage and the third ripple voltage are distortion components.

* * * * *